United States Patent [19]

Unnai et al.

[11] 4,293,586

[45] Oct. 6, 1981

[54] METHOD FOR FORMING A FLUORESCENT SCREEN

[75] Inventors: Takaaki Unnai; Akiya Izumi; Misturu Hinosugi, all of Mobara, Japan

[73] Assignee: Hitachi, Ltd., Tokyo, Japan

[21] Appl. No.: 112,613

[22] Filed: Jan. 16, 1980

[30] Foreign Application Priority Data

Jan. 19, 1979 [JP] Japan ..... 54-3954

[51] Int. Cl.[3] ..... H01J 29/22; B05D 1/36; B05D 7/22

[52] U.S. Cl. ..... 427/68; 427/73

[58] Field of Search ..... 427/68, 73

[56] References Cited

U.S. PATENT DOCUMENTS 3,966,474 6/1976 Harper ..... 427/68 X

*Primary Examiner*—James R. Hoffman

*Attorney, Agent, or Firm*—Charles E. Pfund

[57] ABSTRACT

In forming a fluorescent screen for a cathode ray tube, an undercoat layer is first coated on the inner face of the panel. The undercoat layer contains at least polystyrene particles with a film weight of 0.002 to 0.04 mg/cm$^2$. Coated on the undercoat layer is phosphor slurry.

5 Claims, 1 Drawing Figure

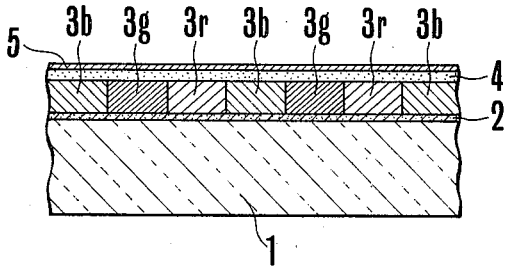
3b
3g
3r
3b
3g
3r
3b
5
4
2
1

METHOD FOR FORMING A FLUORESCENT SCREEN

BACKGROUND OF THE INVENTION

This invention relates to a method of forming a fluorescent screen for cathode-ray tubes.

In cathode-ray tubes, for instance color picture tubes of a shadow mask type, the fluorescent screen comprises phosphor picture elements of three colors, red, blue and green which are arranged regularly on the inner surface of the panel in a predetermined fashion, for instance, of dots or of stripes. In recent years, there has been a popular trend to provide non-luminuous light absorbing material layer (back substance) between one phosphor picture element and another. There has also been used phosphor with pigments wherein pigment is deposited on phosphor particles.

The method of forming a fluorescent screen will now be described in respect of a color picture tube having a non-luminous light absorbing substance layer, that is, popularly known as a black matrix (BM) type color picture tube. More particularly, on the inner face of the panel is formed a photoresist film which is then dried, exposed through a shadow mask and developed to form a photoresist layer of a matrix pattern. Then, a coating of graphite is applied on the photoresist layer and etched to form a BM pattern film. The inner face of the panel and the BM pattern film are thereafter covered by a thin undercoat layer of water soluble polymeric material.

Next, the portion of the panel is successively coated with respective phosphor slurries of green blue and red and exposed to light via the shadow mask separately for each color. Unexposed portion is dissolved by, for instance, developing with warm water to form a phosphor layer of phosphor picture elements of a desired pattern. The phosphor layer is coated with an organic resin film over which is vapor deposited a thin aluminium film. In order to thermally decompose all the organic substances contained in layers of a fluorescent screen, the panel is baked after formation of the thin aluminium film so as to form the fluorescent screen for the color picture tube.

The phosphor screen coating process comprising the above steps has such a disadvantage that phosphor tends to peel off and tear in the developing process using warm water and the like if the adhesive force between the inner face of the panel and the fluorescent film is insufficient.

On the other hand, when the adhesion between the inner face of the panel and the fluorescent film is excessively strong, phosphor will remain in the unexposed portion, causing the color purity to become degraded. The usual method to effectively deposit a phosphor layer on the inner face of the panel is to form a thin undercoat of water soluble polymeric substance on the clean glass panel inner face as described above. Typically, the method comprises washing the inner face of the panel with an aqueous solution of hydrofluoric acid, rinsing with deionized water, coating with diluted polyvinyl alcohol solution at a concentration of about 0.2 to 0.5% by weight and drying it. As a result, an extremely thin undercoat layer of polyvinyl alcohol, almost of the thickness of monomolecular film, is formed upon the inner face of the panel glass.

It is known that this layer improves the adhesive property of a phosphor coating which comprises phosphor particles and polyvinyl alcohol or it is imparted with photosensitivity by dichromic acid which is to be applied in the ensuing step. To further improve the adhesive property, there are available such a method as to improve the coating on the phosphor particle surface, either alone or in combination with the undercoat, a method wherein a sensitizer or silica, silane coupling agent or emulsion which turns into a film by heating, is added to the phosphor slurry or a method wherein ultraviolet rays are irradiated on the outside surface of the panel for a predetermined time at or after the exposure via the shadow mask.

When trying to improve the adhesive property of the phosphor, one finds that phosphor remains on the unexposed area of the panel glass during the development step after exposure, thereby causing cross-contamination and degradation in color purity of the fluorescent screen. Further, phosphor remains on such regions other than the effective area in the unexposed portion, for instance, inside face of the panel glass skirt. And when a color picture tube with such a fluorescent screen is operated, the phosphor adhered to the region outside of the effective area luminesces when the electron beams from the electron gun are overscanned or scattered, impairing the quality of the picture tube.

This presents various structural problems in the picture tube of the type wherein a side portion of the panel is exposed in use from the television set, namely of push-through type.

For eliminating the phosphor remaining on the unnecessary area there have been proposed such methods as a method to adjust conditions for development after exposure such as spray pressure, time or temperature of the warm water, a method to add a certain additive to a slurry containing phosphor and photosensitive binding agent, so-called phosphor slurry, and a method to reduce the concentration and polymerization degree of the binding agent such as polyvinyl alcohol. However, it has not been possible to remove phosphor completely without causing peeling-off and tear of the phosphor layer. Moreover, the inner face of a panel has to be wiped manually or mechanically by a device in order to remove the remaining phosphor outside the effective area of the panel. This has caused various difficulties, resulting in inferior finishing on the panel side or reduced efficiency of operation. Another prior art fluorescent screen forming method has been proposed in which an undercoat layer containing water insoluble organic polymer particles is formed with a film weight of 0.08 to 0.8 mg/cm$^2$. This method can greatly improve the adhesive property of the phosphor film of the exposed area. However, it has been proven by experiments conducted by inventors of this invention that this method has such fatal drawbacks in that the thick undercoat applied causes random reflexion inside and outside of the panel glass at the time of exposure, giving rise to a phenomenon similar to the so-called dark reaction wherein an area outside the predetermined area is exposed to light and thus leaving phosphor on the unexposed region and generating, after the metal back process, that is, during the baking process after the vapor deposited aluminium film formation, blisters on the aluminium film.

The method utilizing the prior-art undercoat layer has critical drawbacks in that the dark reaction occurs depending on the temperature of the panel glass during or after drying following phosphor slurry coating, and atmospheric conditions at the time of exposure such as the temperature and the humidity.

SUMMARY OF THE INVENTION

This invention aims at eliminating the prior art drawbacks and has its object to provide a method for forming an improved fluorescent screen which can prevent peeling off and tear of the phosphor layer and at the same time can eliminate undesirable phosphor which would remain on the unexposed region.

According to this invention, the above object can be accomplished by providing a method for forming a fluorescent screen for a cathode ray tube which comprises coating an undercoat layer containing at least polystyrene particles and of a film weight of 0.002 to 0.04 mg/cm$^2$ prior to coating the phosphor film on the inner face of a panel.

BRIEF DESCRIPTION OF THE DRAWING

The FIGURE shows a fluorescent screen of this invention sectioned prior to baking.

DESCRIPTION OF THE PREFERRED EMBODIMENTS

A liquid for formation of an undercoat of this invention contains at least polystyrene particles in the form of polystyrene latex.

Polystyrene latex herein is a substance which contains at least one of a co-polymer of polystyrene, styrene and styrene type monomer, a co-polymer of styrene and acryl type monomer, a co-polymer of styrene and butadiene type monomer and a co-polymer of styrene, butadiene type monomer and acryl type monomer, the resin being emulsified into particles by an emulsifier.

An undercoat layer using a solution containing the polystyrene latex is formed with the film weight after drying being 0.002 to 0.04 mg/cm$^2$, preferably 0.005 to 0.03 mg/cm$^2$ and a phosphor layer is formed on the undercoat layer. Thus formed phosphor layer will not peel off and tear and it will reduce radically the amount of the phosphor remaining on the unexposed region as compared with the prior art and further, improve prevention of the adhesion on the panel skirt portion. The undercoat can be applied directly on at least a portion of the inner face of the panel glass in intimate contact therewith or can be applied on the light absorbing substance formed on the inner face of the panel.

The phosphor according to the present invention does not remain naturally not only on the unexposed region on the inner face of the panel but also on the unexposed region on the light absorbing substance.

The undercoat layer containing polystyrene particles is the type wherein organic substance contained is evaporated when it is baked at a temperature below 500° C.

The utilization of the undercoat layer containing polystyrene particles and with the film weight being 0.002 to 0.04 mg/cm$^2$ ensures elimination of the prior art drawbacks, presumedly, for the following reasons.

Since polystyrene has excellent water-resistant property and particularly herein is used in the form of particles, the surface area of the undercoat can be larger than the prior art undercoat, for instance, polyvinyl alcohol. On the undercoat is formed a film of phosphor and photosensitive binding agent which is exposed to ultraviolet rays in a desired pattern to form a region with a higher solubility and a region with a lower solubility in the coated film. The region having a higher solubility in respect of water is removed by spraying warm water on the coated film and developing it.

The unexposed region or the region which is not hardened by light is dissolved by warm water, thus removing readily the phosphor from the undercoat layer which is water resistant. The region exposed to the light, on the other hand, is hardened to become hydrophobic with a lower solubility to water. Since the undercoat layer is also hydrophobic, the exposed region has a high affinity to the undercoat layer, securing the adhesion therebetween. There are irregularities on the undercoat layer surface due to polystyrene particles, increasing the adhered area between the undercoat layer and the phosphor layer.

This can further improve the adhesive property of the exposed regions.

In other words, phosphor does not remain on the unexposed regions and there occur no peel-off and tear of phosphors at the exposed regions. Therefore, it is confirmed that neither an excessive nor a suppressed amount of polystyrene can attain the expected effect.

The undercoat layer used in this invention contains polystyrene particles and the film weight thereof is made to be 0.002 to 0.04 mg/cm$^2$, preferably from 0.005 to 0.03 mg/cm$^2$.

The undercoat layer of this type can be obtained by applying an aqueous emulsion containing polystyrene particles of an average diameter of about 0.1 to 0.4 μm whose solid content is from about 0.3 to 4 weight %, preferably 0.5 to 3 wt. % on the inner face of the panel and drying the same. The desired effect of an effective undercoat layer cannot be attained if the film weight is less than 0.002 mg/cm$^2$. Conversely, for the film weight exceeding 0.04 mg/cm$^2$, blisters are caused on the aluminium film after the baking step or phosphor remains at the unexposed regions. The amount of the solid content was previously set to about 0.3 to 4 wt. % as above-mentioned, but this is not limited to the above values and can be arbitrarily selected so far as it is possible to adjust the film weight to a predetermined value.

Polystyrene latex of the undercoat layer may be added with an adhesive reinforcing agent such as colloidal silica, silane coupling agent, sodium or potassium silicate or the like of an amount of 1 wt. % at most, preferably of 0.05 to 0.5 wt. %. With this composition, the adhesive property of the phosphor layer and the close contact between the undercoat layer and the inner face of the panel glass are improved, along with the adhesive force of the aluminium film after baking being effectively retained. However, when the amount of the additive, the adhesive reinforcing agent, exceeds 1 wt. %, as experimentally confirmed, irregular undercoat layers and poor brightness of the fluorescent screen result. Naturally, even if the adhesive reinforcing agent is added, the film weight of the undercoat layer after drying should not deviate from the desirable range of 0.002 to 0.04 mg/cm$^2$.

When water soluble resins such as polyvinyl alcohol, polyacrylamid, polyvinyl pyrolidone or the like of 0.5 wt. % at maximum are added to the composition containing polystyrene latex and the adhesive reinforcing agent, the adhesive property of the phosphor layer and the uniformity of the undercoat layer can effectively be improved. Obviously, it is necessary that the film weight of the undercoat layer be within the range of 0.002 to 0.04 mg/cm$^2$ even when such water soluble resins are added. If the amount of the additive exceeds 0.5 wt. %, there arise such problems as tendency of the phosphor to remain at the unexposed region and reduction of the adhesive property of the phosphor layer at the exposed region.

A small amount of one or more of a film plasticizer, a viscosity intensifier agent, a surface active agent and the like may be added to the various compositions, if the necessity be. Examples of this invention will be described below. Each composition shown is in weight percentage.

EXAMPLE 1

Polystyrene latex (saibinol available from Saiden Chemical Corp) (solid): 1.2%
Water: the remainder The above two ingredients are mixed to prepare an under-coating liquid. Undercoating the panel with the above liquid comprises washing the inner face of the panel, inclining the panel inner face by an angle of 30° to 75°, laterally injecting a predetermined amount of the emulsion of the above composition from a nozzle under a predetermined pressure while rotating the panel about its axis at a speed of 10 to 30 rpm.

After the panel inner face is coated with emulsion, the panel is rotated at 100 to 180 rpm to remove surplus emulsion, thereby forming a film of a uniform thickness on the panel inner face. Thereafter, drying by a heater follows to form a undercoat layer with the film weight of 0.012 mg/cm$^2$.

Then, phosphor for the first color is applied by usual slurry method and process steps of drying, exposing, developing and drying are conducted to form the phosphor layer.

The steps of the slurry method after the formation of phosphor film are conducted successively in a similar manner to the first color for the second and the third colors respectively so as to form phosphor layers at predetermined respective locations. Then, the usual processes such as coating with a resin film, metal backing and baking are carried out to complete a fluorescent screen.

The accompanying single FIGURE shows schematically an example of the fluorescent screen before subjected to the baking process, wherein reference number 1 denotes a panel, 2 an undercoat layer, **3*b*, 3*g* and 3*r* phosphor layers of blue, green and red, 4 a resin layer and 5** a metal back layer.

The fluorescent screen thus formed had neither phosphor remaining on the unexposed regions nor unnecessary phosphor adhered to the inner face of the panel glass skirt and was of excellent color purity being immune from peeling-off and tear. Since this was very thin undercoat which can suppress increase of the total organic solid contents in the fluorescent screen blisters which might be caused by the gas generating from decomposed organic substances at the time of baking process did not appear on the aluminium film.

EXAMPLE 2

Polystyrene latex (solid): 0.8%
Colloidal silica (Snowtex available from Nissan Chemical Industries, Ltd.): 0.3%
Water: the remainder For preparing this composition, the liquid is first diluted with water. The commercially available component substances are balanced and added with emulsion droplets one by one while stirring. After sufficiently stirring, aqueous ammonia or aqueous solution of acetic acid is added so as to achieve a pH value of from 6.5 to 7.5. Before using the emulsion mixture, the mixture is filtered to remove aggregates and foreign substances.

An undercoat layer with the film weight of 0.008 mg/cm$^2$ is formed from the under-coating liquid of the above composition by a process similar to the first example. Then, a fluorescent screen is formed by a method similar to the first Example to achieve the same effect as the first one.

EXAMPLE 3

Polystyrene latex (solid): 2%
Silane coupling agent (KBM 603 available from Shin-Etsu Chemical Co., Ltd.): 0.1%
Water: the remainder Out of the above composition, an undercoat layer of the film weight of 0.02 mg/cm$^2$ is formed by a similar method to the second Example and a fluorescent screen is formed by a similar method to the first Example.

EXAMPLE 4

Polystyrene latex (solid): 1%
Colloidal silica: 0.1%
Polyvinyl alcohol (Poval available from Kurashiki Rayon Co., Ltd.): 0.1%
Water: the remainder Out of the above composition, an undercoat layer with the film weight of 0.015 mg/cm$^2$ is formed by a similar method to the second Example and a fluorescent screen is formed by a similar method to the first Example.

EXAMPLE 5

Polystyrene latex (solid): 0.5%
Colloidal silica: 0.5%
Polyvinyl alcohol: 0.2%
Water: the remainder Out of the above composition, an undercoat layer with the film weight of 0.007 mg/cm$^2$ is formed by a similar method to the second Example and a fluorescent screen is formed by a similar method to the first Example.

As described in the foregoing, this invention provides a phosphor layer by forming an undercoat layer containing polystyrene particles and of the film weight of 0.002 to 0.04 mg/cm$^2$, whereby a fluorescent screen can be devoid of any defective portion on the whole area and phosphor remaining on the unexposed regions without necessitating additional steps to the conventional process. According to the method of the present invention, there occur no blisters which are often caused by the gas released from decomposed organic substances at the baking process. Further, without leaving the residue of the under-coat layer, the phosphor layer with excellent color purity is obtained.

Moreover, problems related to the dark reaction would not arise since the weight of the film is smaller than the conventional one, thereby preventing phosphor to remain and simultaneously improving operational conditions such as drying conditions. This invention obviously can be applied to formation of the fluorescent screen for color picture tubes irrespective of presence of the black substance and also to the method of fluorescent screen formation for other types of cathode ray tube.

What is claimed is:

1. A method for forming a fluorescent screen on a panel of a cathode ray tube comprising the steps of coating on the inner face of the panel an undercoat layer containing at least polystyrene particles and having a film weight of 0.002 to 0.04 mg/cm$^2$, wherein the undercoat layer is made from an aqueous emulsion containing polystyrene particles of an average grain size of about 0.1 to 0.4 $\mu$m whose solid content is from about 0.3 to 4 weight %, and coating phosphor slurry on the undercoat layer.

2. A method for forming a fluorescent screen as claimed in claim 1 wherein the film weight is in the range of 0.005 to 0.03 mg/cm$^2$.

3. A method for forming a fluorescent screen as claimed in claim 1 wherein the undercoat layer further comprises an adhesive reinforcing agent.

4. A method for forming a fluorescent screen as claimed in claim 3 wherein the undercoat layer further comprises water soluble resins.

5. A method for forming a fluorescent screen as claimed in any of claims 1 to 4 wherein the undercoat layer further comprises at least one of a film plasticizer, a viscosity intensifier agent and a surface active agent.

* * * * *